US006119345A

United States Patent [19]

Lydic et al.

[11] Patent Number: 6,119,345

[45] Date of Patent: Sep. 19, 2000

[54] METHOD OF COLD FORMING CENTER SILL FOR A RAILCAR

[75] Inventors: Todd L. Lydic, Johnstown, Pa.; Tamo Bianchi, Oakville, Canada

[73] Assignee: Johnstown America Corporation, Johnstown, Pa.

[21] Appl. No.: 08/953,337

[22] Filed: Oct. 17, 1997

Related U.S. Application Data

[63] Continuation-in-part of application No. 08/712,369, Sep. 11, 1996.

[51] Int. Cl.[7] ..... B21D 53/88

[52] U.S. Cl. ..... 29/897.2; 105/416; 72/181

[58] Field of Search ..... 29/897.2, DIG. 49; 105/416, 417, 418; 72/181, 178, 52

[56] References Cited

U.S. PATENT DOCUMENTS

| | | | |
|---|---|---|---|
| 25,414 | 9/1859 | Horstmann . | |
| 785,781 | 3/1905 | Waggoner . | |
| 1,279,600 | 9/1918 | Slick . | |
| 1,360,774 | 11/1920 | Emby . | |
| 2,082,792 | 6/1937 | Dean . | |
| 3,861,009 | 1/1975 | Baxter | 72/181 |
| 3,877,275 | 4/1975 | Attwood | 72/181 |
| 4,109,499 | 8/1978 | Brooks et al. | 72/181 |
| 4,254,714 | 3/1981 | Heap . | |
| 4,267,954 | 5/1981 | Smith | 72/181 |
| 4,493,266 | 1/1985 | Augustine, Jr. . | |
| 4,543,887 | 10/1985 | Baker . | |
| 4,580,388 | 4/1986 | Maisch . | |
| 4,663,957 | 5/1987 | Ishii et al. | 72/181 |
| 4,770,018 | 9/1988 | Bosl et al. | 72/181 |
| 4,986,051 | 1/1991 | Meyer et al. . | |
| 5,056,348 | 10/1991 | Albrecht et al. | 72/181 |
| 5,157,883 | 10/1992 | Meyer . | |
| 5,319,952 | 6/1994 | Cadney | 72/181 |
| 5,860,366 | 1/1999 | Lydic | 105/416 |
| 5,875,668 | 3/1999 | Kobyashi et al. | 72/181 |

*Primary Examiner*—I Cuda
*Assistant Examiner*—Trinh Nguyen
*Attorney, Agent, or Firm*—Webb Ziesenheim Logsdon Orkin & Hanson, P.C.

[57] ABSTRACT

A center sill for a railroad car formed by cold rolling a flat sheet of steel into a rectangular configuration. One of the embodiments includes strengthening flanges and another includes ribs. The center sill may be formed of a single cold formed section or a pair of cold formed sections joined by a single longitudinal weld seam.

20 Claims, 3 Drawing Sheets

METHOD OF COLD FORMING CENTER SILL FOR A RAILCAR

This is a continuation-in-part of U.S. patent application Ser. No. 08/712,369 filed on Sep. 11, 1996.

BACKGROUND OF THE INVENTION

1. Field of the Invention

This invention relates, in general, to railroad cars and, more specifically, to a cold formed center sill and its method of manufacture.

2. Summary of the Prior Art

The center sill is the primary structural member of the underframe of a railcar. It is subjected to the buff and draft forces created during operation of the railcar and normally extends as a continuous member along the length of the car body. In the past, center sills have possessed many different cross-sectional configurations depending on the type of railcar and other considerations. Center sills have been in the shape of hat designs, C-sections and other configurations. Regardless of its particular shape, it is well known to form a center sill by welding a plurality of hot rolled flat pieces or hot rolled sections together as a unit along its substantial length. The use of numerous welds to manufacture center sills presents several long-existing problems. Because numerous welds are needed, the reliance on this process to fabricate a finished center sill is inefficient from both a cost and productivity standpoint. The application of the welds along the lengths of the pieces being joined as a center sill is labor-intensive and cannot attain high-speed production. In addition, the application of multiple welds heats the material being joined and results in heat distortion and warpage. Warpage creates deviations in the straightness or acceptable tolerances of the center sill being formed. As a result, further physical steps are needed to finish the welded center sill unit and conform it to acceptable tolerances in camber, sweep and twist to be suitable for use in a railroad car. Existing center sills are subject to crippling of the webs which requires thicker cross sections at critical structural areas. Furthermore, hot rolled sections do not always result in the desired tolerances for the finished camber of the sill. As an additional important consideration, a welded center sill is an inherently heavy structure due to its design and fabrication technique. Accordingly, it is desirable in the prior art to provide an improved, lightweight center sill in which the necessity of a plurality of welds or other securement techniques are eliminated.

SUMMARY OF THE INVENTION

It is an objective of this invention to provide an improved center sill capable of being cold formed into a straight member having close tolerances. The various configurations of the several embodiments of the invention are cold formed at a plurality of cold rolling stations from a plate or sheet of coiled steel. The flat sheet undergoes progressive formation at each rolling station whereby drawings of the steps of shaping developed by each roll station, when superimposed, form a flower diagram to assist the roll tooling designer. The center sills herein disclosed can be formed on a continuous basis without interruption between separate center sills. One unique cold forming process of the invention allows center sills having a thickness up to ⅝ inch to be formed without the use of welds as in the prior art. Because the bent sections forming the shape of the center sill are cold worked numerous times during working, the material is strengthened to resist crippling and produce a stronger cross section without thicker sections or reinforcing material. The center sills are open at the bottom to provide desired access within the center sill body. Some of the configurations of the center sill include extra structural features that provide enhanced strength characteristics without adding a significant weight.

A complete understanding of the invention will be obtained from the following description when taken in connection with the accompanying drawing figures wherein like reference characters identify like parts throughout.

DESCRIPTION OF THE PREFERRED EMBODIMENTS

Figure 1:
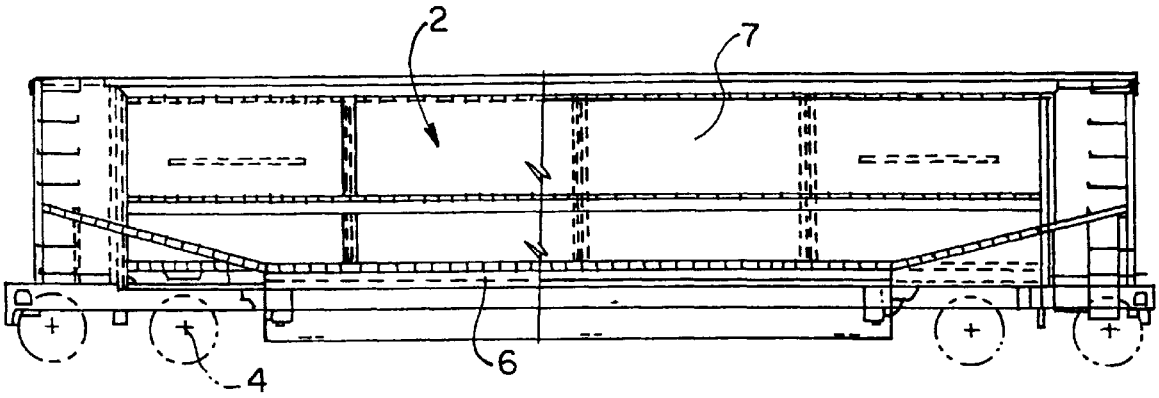
FIG. 1 is a side elevational view, with parts in section, showing any of the center sill embodiments of the invention on a rail car.

Referring to FIG. 1, there is illustrated a railroad gondola car 2 for carrying commodities such as coal, gravel and the like and having an underbody carried by opposed truck assemblies 4. The underbody of the railroad car of the invention includes a continuous single piece center sill 6 extending substantially the entire length of the car. A railcar body 7 is attached to the underframe. As will be apparent from the following description, the single piece center sills of several embodiments of the invention provide significant advantages over prior center sills and contribute to a lightweight, economical car design. Although the center sills of the invention are shown with reference to the gondola car of FIG. 1 by way of illustration, it is within the scope of the invention to use the single or the two-piece center sill herein disclosed with any type or design of rail freight car in which the advantages of the invention are desired.

Figure 2:
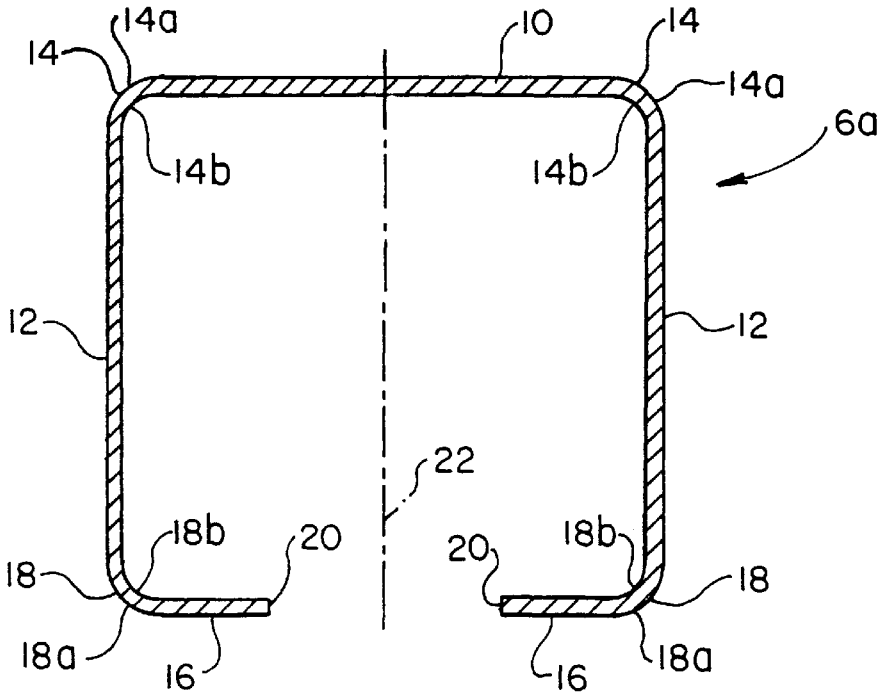
FIG. 2 is a cross-sectional view of a first embodiment of a single piece center sill for use with a railroad car such as illustrated in FIG. 1.

Referring now to FIG. 2, there is illustrated the first embodiment of the single piece center sill of the invention, generally designated by reference numeral **6*a*. The center sill 6*a* of FIG. 2 is formed from a suitable steel by a cold rolling process to be described. The center sill 6*a* is formed in a generally rectangular configuration from a flat one-piece plate or coiled sheet of steel and is continuous along its length. The center sill is formed by bent sections created in the cold forming process from a material having a thickness of up to ⅝ inch with thicknesses of either ⅜ inch to ⅝ inch being preferable. The center sill 6*a* includes an upper flat top wall 10 and a pair of flat side sections or webs 12**, each of generally constant thicknesses.

The top wall 10 and pair of side sections 12 are joined together at right angles by upper curved sections 14 having curved outer surfaces **14*a* and curved inner surfaces 14*b*, the latter being formed about a common radius such as, for example, 15/16 inch. The bottom sections 16 of the center sill 6***a* are inwardly formed horizontally at right angles to the side sections 12 through curved connecting sections 18 having curved outer surfaces 18*a* and curved inner surfaces 18*b*, the latter being of constant radius such as, for example, approximately 15/16 inch. The bottom sections 16 terminate with a free end 20 to form a longitudinal opening 22 through which access within the center sill 6*a* is provided. By way of example, the bottom sections 16 forming the bottom portions of the center sill may each extend approximately 4 inches from the side sections 12 and create the bottom opening 22 having a width of approximately 5 to 6 inches. The center sill 6*a* preferably possesses an average yield strength throughout its length of at least 70,000 PSI and an average tensile strength of at least 80,000 PSI to easily meet all strength requirements for the center sill, but these values may be as low as 50,000 PSI and 65,000 PSI, respectively. The curved sections 14 and 18 are cold worked numerous times during the cold rolling process. As a result, the material is cold hardened and strengthened at sections 14 and 18 as compared to its original unformed state. The resulting cross section does not require thicker sections or added material as in the prior art and provides a lightweight, high-strength member.

Figure 3:
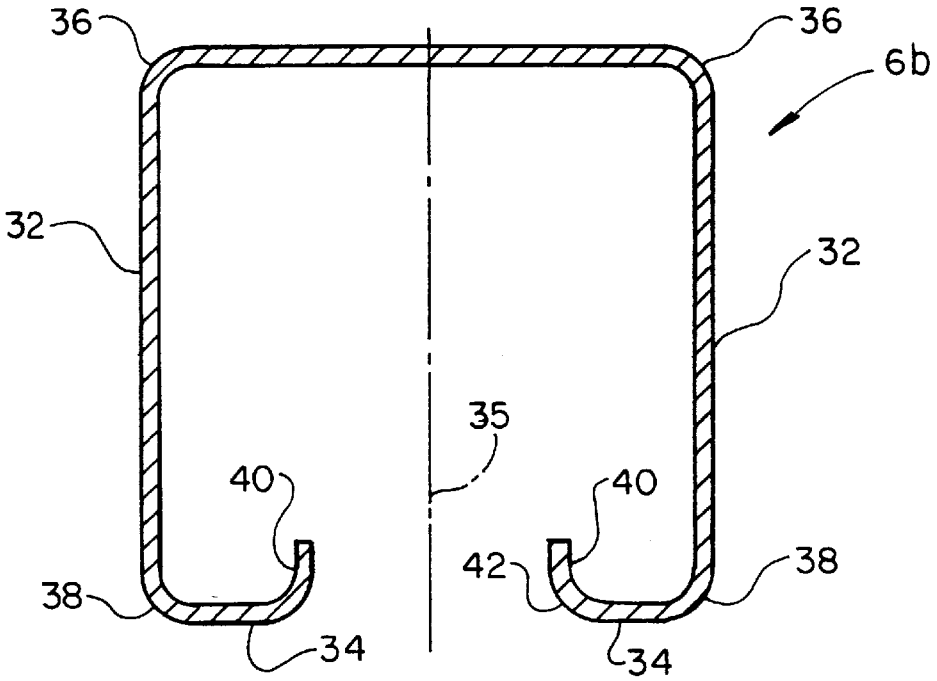
FIG. 3 is a cross-sectional view of a second embodiment of the single piece continuous center sill invention for use with a railroad car such as illustrated in FIG. 1.

Referring to FIG. 3, there is illustrated the second embodiment of the center sill of the invention. The center sill 6*b* of FIG. 3 includes upper top wall 30, opposite side sections or webs 32 and bent in bottom portions 34 creating opening 35. The top walls 30, opposed side sections 32 and bottom portions 34 are respectively interconnected by upper curved sections 36 and lower curved sections 38 having a similar configuration as the embodiment of FIG. 3. As in the prior art, the curved sections 36 and 38 are cold hardened during rolling for increased strength. The center sill 6*b* further includes a pair of upright internal flange portions 40 extending upward and being joined to bottom portions 34 by curved sections 42 of constant radius similar as curved sections 36 and 38. The center sill 6*b* is cold formed in progressive steps as the previous embodiment to obtain its configuration, but initially from a wider sheet or plate material. The curved sections 42 are also cold hardened during rolling for increased strength. As a result, the cross section of the center sill 6*b* includes more material for similar external dimensions than the configuration of the embodiment of FIG. 2 because of flange portions 40 to provide greater strength characteristics and high resistance to buckling, with only a minimum increase in weight. The thickness of center sill of FIG. 3 is preferably up to 5/8 inch, with 3/8 to 5/8 inch being preferred. The configuration exceeds the strength characteristics of the preceding embodiment for the same dimensions and material and is also continuously formed from a one-piece coiled sheet or plate.

Figure 4:
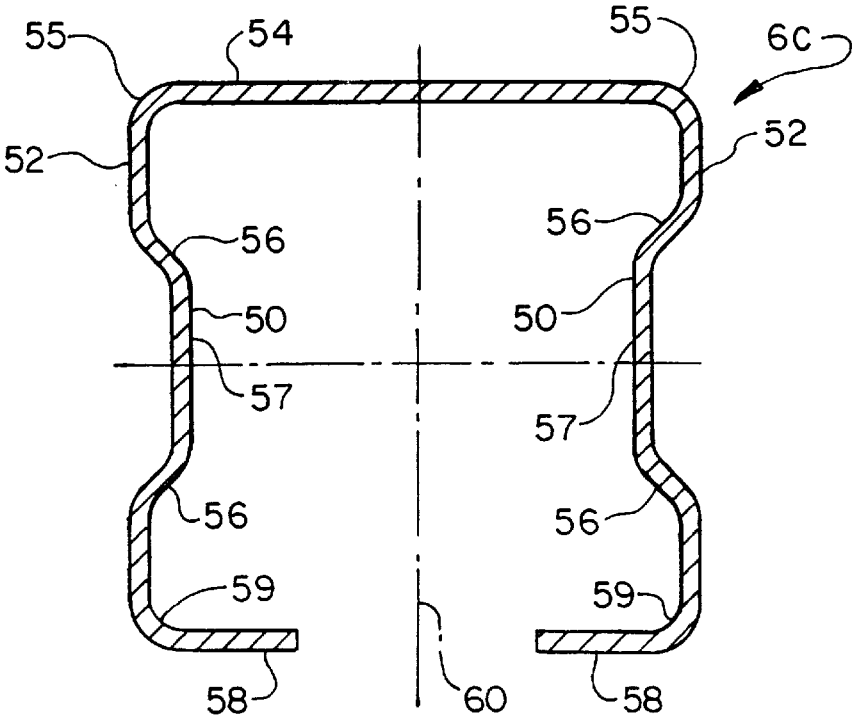
FIG. 4 is a cross-sectional view of a third embodiment of the single piece center sill of the invention for use with a railroad car such as illustrated FIG. 1.

Referring now to FIG. 4, there is illustrated the third embodiment of the invention, generally designated by reference numeral 6*c*. The configuration of the center sill 6*c* is also similar to the embodiment of FIG. 2, but further includes a pair of inwardly disposed ribs 50 rolled out of the two side sections for webs 52 of the center sill 6*c*. The inwardly directed ribs 50 serve as stiffeners for the elongated center sill and are cold formed during the first stations in the rolling process. The center sill 6*c* includes a top wall 54 which is oriented at 90° to side sections 52 by a curved portion 55 having an approximate radius, for example, of 15/16 inch and the like. The ribs 52 include inwardly extending connecting portion 56 of a length less than an inch and have a flat internal wall 57 to rigidize the center sill. The connecting portions 56 are also worked hardened as are curved portions 55. The bottom of the center sill includes a pair of partial horizontal bottom sections 58 integral to side sections 52 by curved sections 59. The bottom sections define longitudinal bottom opening 60 along the center sill 6*c*. Although other sizes and dimensions may be employed in accordance with the invention, the center sill 6*c* may have a width of approximately 1 foot, 13/16 inch and a height of approximately 1 foot, 15/16 inch and the like. The embodiments described with reference to FIGS. 2 and 3 may have similar or external dimensions. The internal wall 60 of the ribs 50 may extend for a height of 3 to 4 inches or other suitable dimension. The bottom sections 58 may extend for approximately 4 inches at the bottom. The center sill 6*c* may be cold formed from a steel having a preferable tensile strength of 70 KSI, but also as low as 50 KSI. Center sill 6*c* provides additional yield strength due to the presence of the stiffening ribs 50 for the same size and material as compared to the embodiment of FIG. 2, but only adds minimal weight to the overall structure of the beam.

Figure 5:
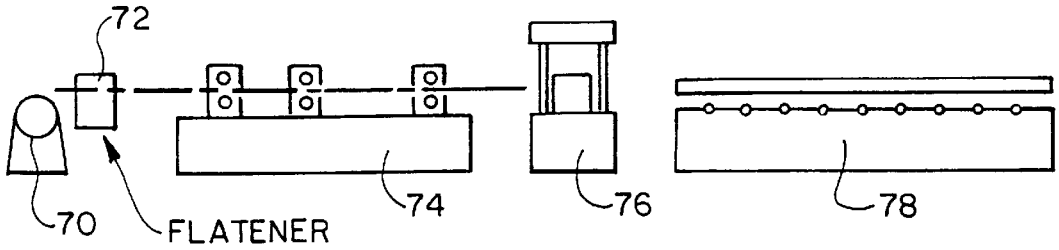
FIG. 5 is a schematic diagram of the cold forming apparatus for forming the cold formed center sill of the several embodiments of the invention.

Referring now to FIG. 5, a schematic view of the technique of cold rolling the various embodiments of the center sill of the invention is illustrated. Coiled steel in sheet form is carried by a conventional uncoiler 70. In the embodiment of FIG. 2, the width of the coiled metal may be, for example, 46 inches. As is well known, the stations of the rolling mill 74 comprise roll formers positioned at different orientations at each station to cause the progressive deformation of the sheet material into the desired configuration. During the initial setup of the process, the steel coil is opened and fed through a flattener apparatus 72 to remove coil set. The lead end of the coil is trimmed and joined to the trailing end of the previous length of material in a shear welder. The plate or sheet material is fed to a forming mill 74 comprising 10 or more pairs of roll forming stations to progressively form the flat material into the finished shape as shown in FIGS. 2, 3 and 4.

In the formation of the embodiment of FIG. 2, the flat plate or sheet material undergoes bending at a plurality of stations, such as 10 or more, that create the final cold formed shape of the center sill of FIG. 2 to be formed. In connection with the embodiment of FIG. 3, added stations are required for the first several steps to form the bent up internal flange portions 40. As to the embodiment of FIG. 4, the rib sections 50 are also formed during the first several steps of the rolling process during passage of the sheet material through the rolling mill 74.

After the final station in rolling mill 74 is passed, the formed single piece center sill is delivered to a cutoff press 76 which cuts the center sill to the desired length without stopping the rolling process. The separated center sill then is conveyed to a conveyor 78 on which the profile of the center sill is inspected to determine whether its dimensions are correct and whether acceptable tolerances of camber, sweep and twist have been maintained. The cold forming process of the invention attains significantly close tolerances in the final product of the center sill by a process that is capable of high production with minimum labor. This capability provides a vastly superior product with economical manufacture and a beam structure of high quality and precise shape. The single piece center sill of the invention is lightweight, being approximately 1,000 pounds or more lighter than conventional welded sills.

Figure 6:
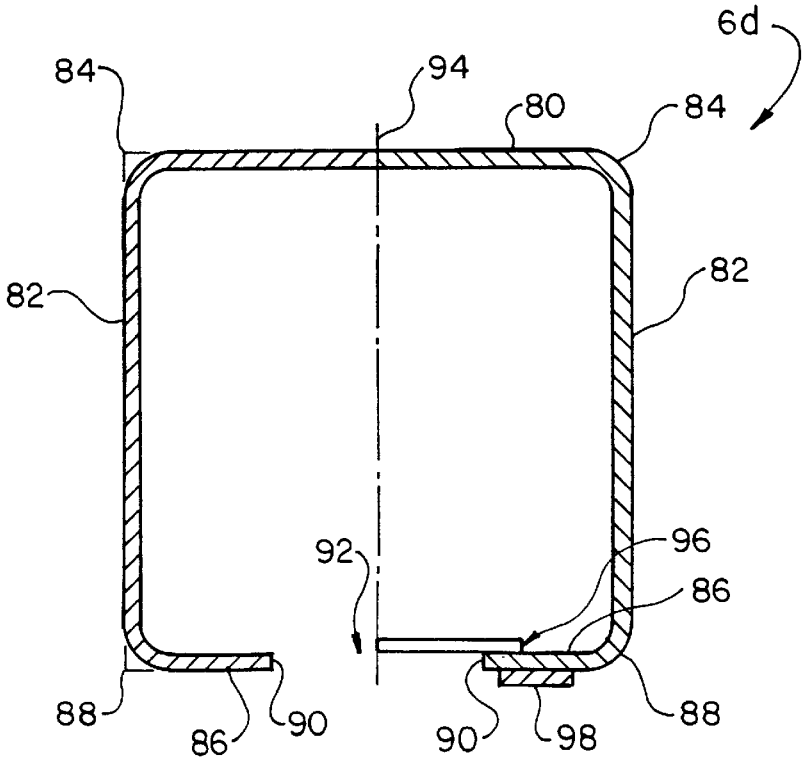
FIG. 6 is a cross-sectional view of a fourth embodiment of the cold formed center sill of the invention for use with a railroad car such as illustrated in FIG. 1.

Referring now to FIG. 6, there is illustrated a fourth embodiment of the present invention, generally designated by reference numeral 6*d*. The configuration of the center sill 6*d* is similar to the previous embodiments and includes a top wall 80 connected to a pair of side sections 82 through upper curved sections 84. Each side section 82 is connected to a bottom section 86 through lower curved sections 88. Each bottom section 86 terminates at a free end 90 forming a longitudinal opening 92 therebetween. The dimension of the center sill 6*d* is substantially the same as center sill 6*a* described above in connection with FIG. 2. The center sill 6*d* differs from center sill 6*a* by being formed of two separate cold formed halves connected by a single longitudinal weld 94. FIG. 6 also shows a bottom tie plate 96 and a bottom flange stiffener 98 attached to the center sill 6*d* which may be required on certain railcar designs.

The two-piece cold formed center sill 6*d* maintains many of the advantages of the one-piece embodiments 6*a,* 6*b* and 6*c* described above. The cold forming process provides sections with significantly less variance from the specified section than the prior art hot rolled sections. Additionally, the use of a single weld minimizes the assembly time associated with prior multi-weld configurations. The center sill 6*d* also exhibits a significant weight savings over the known prior art center sills. The two-piece center sill 6*d* is advantageous where the specific rolling mill 74 cannot accommodate the complete center sill cross section. A rolling mill 74 may not contain enough stations to complete the entire cross section. In this case, the rolling mill can form two cold formed halves to form the center sill 6*d* of FIG. 5. The cross sections of the center sills 6*b* and 6*c* shown in FIGS. 3 and 4 may similarly be formed of two halves subsequently welded together.

Superior strength characteristics of the center sill of the invention are attained by using a steel such as an ASTM A607, grade 70 or an ASTM A935, grade 70 for a plate or sheet having a thickness ⅜ inch. With a thicker sheet of material, such as ½ inch, an ASTM A607, grade 50 steel may be used with coiled plate or an ASTM A572, grade 50 with a coiled sheet. One suitable ASTM A607, grade 70 steel for thicknesses of ⅜ inch is known as Type 1, sold under the trademark Stelmax 70™. Stelmax 70™ has an expected yield strength of 76 KSI and a tensile strength of 86 PSI. Other steels of the type described demonstrating similar properties may be used with the invention.

Some of the advantages of the present invention are highlighted with a comparison of the present invention with a standard center sill.

| | Standard Center Sill | ⅜ Inch Thick One-Piece Center Sill 6b w/upturned flange | ⅜ Inch Thick Two-Piece Center Sill 6d w/o upturned flange | ½ Inch Thick One-Piece Center Sill 6b | ½ Inch Thick Two-Piece Center Sill 6d |
|---|---|---|---|---|---|
| Minimum Yield Point (KSI) | 50 | 70 | 70 | 50 | 50 |
| Minimum Tensile (KSI) | 65 | 80 | 80 | 60 | 60 |
| Weight Per Foot | 82.4 | 60.2 | 56.5 | 80.0 | 74.4 |

Additionally, a 3K frame Bethgon Coalporter® railcar utilizing the center sill ⅜ Inch 6*d* was loaded to 286K gross rail load and standard AAR loads and load factors were applied. This was compared to the same type of railcar utilizing a standard center sill. The margin of safety against yield failure of the material in the center sill was greater for center sill 6*d*.

The above comparison illustrates that the cold formed center sills of the present invention offer significant advantages over the prior art center sills without detrimental drawbacks. It will be apparent to those of ordinary skill in the art that various changes may be made to the present invention without departing from the spirit and scope thereof. Consequently, the present invention is intended to be defined by the appended claims.

What is claimed is:

1. A method of cold forming a center sill for a railcar, said method comprising the steps of:

supplying at least one flat steel member to a rolling mill along a first path;

subjecting said flat member to a plurality of roll forming stations to progressively bend said flat steel member about said first path; and bending said flat member at said plurality of roll forming stations to form a cold formed center sill section of a railcar, wherein no more than two of said cold formed center sill sections form said center sill which has a hollow, generally rectangular configuration.

2. The method according to claim 1 further including the step of making at least two curved bends of approximately 90° at said plurality of roll forming stations for each flat steel member.

3. The method according to claim 2 wherein said at least four curved bends are work hardened at said plurality of roll forming stations.

4. The method according to claim 1 wherein said center sill is a one-piece center sill formed of a single said center sill section, further including the step of making at least six curved bends of approximately 90° at said plurality of roll forming stations.

5. The method according to claim 1 wherein said cold formed center sill includes a pair of bottom wall portions having spaced ends, and a first of said plurality of roll forming stations form vertical strengthening flanges on said spaced ends of said bottom wall portion.

6. The method according to claim 1 wherein said flat steel member is continuously supplied from a coiled steel sheet.

7. The method according to claim 6 wherein said coiled steel sheet has a yield strength of at least 50 KSI and a generally constant thickness of ⅜ inch.

8. The method according to claim 6 wherein said coiled steel sheet has a yield strength of at least 50,000 PSI and a generally constant thickness of ½ inch to ⅝ inch.

9. The method of claim 1 further including the step of supporting said cold formed center sill on a pair of spaced truck assemblies, wherein said cold formed center sill forms a portion of an underbody for a railcar.

10. A method of forming a center sill for a railcar, said method comprising the steps of:

supplying at least one flat steel member to a rolling mill along a first path;

subjecting said flat member to a plurality of cold roll forming stations to progressively bend said flat steel member about said first path;

bending said flat member at said plurality of roll forming stations to cold form a cold formed center sill section for a railcar, wherein no more than two of said cold formed center sill sections form said center sill which has a hollow, generally rectangular configuration; and supporting said cold formed center sill on a pair of spaced truck assemblies, wherein said cold formed center sill forms a portion of an underbody for a railcar.

11. The method according to claim 10 further including the step of making at least two curved bends of approximately 90° at said plurality of roll forming stations for each flat steel member.

12. The method according to claim 11 wherein said at least four curved bends are work hardened at said plurality of roll forming stations.

13. The method according to claim 10 wherein said center sill is a one-piece center sill formed of a single said center sill section, further including the step of making at least six curved bends of approximately 90° at said plurality of roll forming stations.

14. The method according to claim 10 wherein said cold formed center sill includes a pair of bottom wall portions having spaced ends, and wherein a first of said plurality of roll forming stations forms vertical strengthening flanges on said spaced ends of said bottom wall portion.

15. The method according to claim 10 wherein said flat steel member is continuously supplied from a coiled steel sheet.

16. The method according to claim 15 wherein said coiled steel sheet has a yield strength of at least 50 KSI and a generally constant thickness of ⅜ inch.

17. The method according to claim 15 wherein said coiled steel sheet has a yield strength of at least 50,000 PSI and a generally constant thickness of ½ inch to ⅝ inch.

18. A method of forming a center sill for a railcar, said method comprising the steps of:

supplying one flat steel member to a rolling mill along a first path;

subjecting said flat member to a plurality of cold roll forming stations to progressively bend said flat steel member about said first path and bending said flat member at said plurality of roll forming stations to cold form a cold formed center sill section for a railcar, wherein no more than one said cold formed center sill section forms said center sill, and said cold formed center sill having a hollow, generally rectangular configuration;

supporting said cold formed center sill on a pair of spaced truck assemblies, wherein said cold formed center sill forms a portion of an underbody for a railcar; and attaching a railcar body to said underbody.

19. The method according to claim 17 wherein said flat member has a yield strength of at least 50 KSI and a generally constant thickness of ⅜ inch.

20. The method according to claim 17 wherein said flat member has a yield strength of at least 50,000 PSI and a generally constant thickness of ½ inch to ⅝ inch.

* * * * *

UNITED STATES PATENT AND TRADEMARK OFFICE
Certificate

Patent No. 6,119,345 Patented: September 19, 2000

On petition requesting issuance of a certificate for correction of inventorship pursuant to 35 U.S.C. 256, it has been found that the above identified patent, through error and without deceptive intent, improperly sets forth the inventorship.

Accordingly, it is hereby certified that the correct inventorship of this patent is: Todd L. Lydic, Johnstown, PA; Tamo Bianchi, Ontario, Canada; and James A. Decker, Windber, PA.

Signed and Sealed this Sixth Day of November 2001.

S. THOMAS HUGHES
*Supervisory Patent Examiner*
Art Unit 3726